United States Patent [19]

Pilling

[11] 4,242,154

[45] Dec. 30, 1980

[54] PREHEAT AND CLEANING SYSTEM

[75] Inventor: James T. Pilling, Upland, Calif.

[73] Assignee: Kaiser Steel Corporation, Oakland, Calif.

[21] Appl. No.: 81,531

[22] Filed: Oct. 3, 1979

Related U.S. Application Data

[60] Continuation of Ser. No. 930,420, Aug. 2, 1978, abandoned, which is a division of Ser. No. 863,226, Dec. 22, 1977, abandoned.

[51] Int. Cl.[3] ..... C21D 1/48

[52] U.S. Cl. ..... 148/16.7; 148/156; 427/321

[58] Field of Search ..... 148/16.7, 156; 266/102, 266/103; 432/143, 147, 148, 164; 427/321

[56] References Cited

U.S. PATENT DOCUMENTS

| | | | |
|---|---|---|---|
| 1,238,011 | 8/1917 | Ellis | 432/143 |
| 1,310,911 | 7/1919 | John | 432/164 |
| 1,409,119 | 3/1922 | Scanlon et al. | 432/78 |
| 1,716,956 | 6/1929 | Hepburn et al. | 266/103 |
| 2,587,900 | 3/1952 | Robiette | 148/16.7 |
| 2,933,425 | 4/1960 | Hess | 148/13 |
| 3,166,304 | 1/1965 | Alexeff | 432/229 |
| 3,720,546 | 3/1973 | Ayusawa et al. | 148/156 |
| 3,721,520 | 3/1973 | Bloom | 432/143 |
| 4,069,008 | 1/1978 | Bloom | 432/8 |

*Primary Examiner*—L. Dewayne Rutledge
*Assistant Examiner*—John P. Sheehan
*Attorney, Agent, or Firm*—Naylor, Neal & Uilkema

[57] ABSTRACT

A continuous cleaning and preheating system for steel strip to be annealed prior to being coated or otherwise treated wherein controlled reducing steps are employed to remove surface contaminants from the strip, which system uses direct flame heating whereby the combustion gases from open flame burners within a closed furnace flow into and along a restricted elongated tubular zone so that the gases are in direct contact with the strip as it enters and passes through the tubular zone and the furnace in a direction countercurrent to the flow of the said gases.

5 Claims, 4 Drawing Figures

PREHEAT AND CLEANING SYSTEM

This is a Continuation, of application Ser. No. 930,420, filed Aug. 2, 1978, now abandoned which is a divisional application of Ser. No. 863,226, filed Dec. 22, 1977, now abandoned.

FIELD OF INVENTION

This invention relates to the continuous annealing of steel, and more specifically it relates to a continuous system for cleaning and preheating steel strip or the like prior to annealing the same in preparation for galvanizing or other operations that require a clean surface on the strip which is free of oxides and other residual matter, so as to achieve improved product quality and production efficiency.

In the continuous annealing of steel it is necessary to preheat and clean the steel strip as it comes from the prior fabricating and handling units because the steel strip frequently has residual rolling oils and other surface contaminants which must be removed. To accomplish this, the prior art has first preheated the strip surface to reduce or oxidize and otherwise process the oils and other contaminants thereon. The strip then enters a hydrogen-rich reducing atmosphere that reacts to completely remove any treated residual contaminants that are on the strip after it has been deposited as the strip travels through the preheat chamber where it has been in flame contact with the furnace heating gases. This cleaning method is often preferred over the practice of removing the surface impurities by contact with a mechanical cleaner. Accordingly, the open flame system that will process the surface of the strip preparatory to its entering the annealing area of the furnace proper has been generally adopted by the steel industry. It both cleans and preheats the strip and thus helps to increase production rates. This invention is concerned with an improved gas preheating and cleaning system.

DESCRIPTION OF PRIOR ART

In the prior art continuous annealing systems which are in general use the strip enters from the ambient atmosphere directly into a preheat furnace of a general muffle or oven-type or of a direct flame contact design through rolls or other sealing means at its entry point. The furnace is inefficient because in order to obtain any degree of effective cleaning and surface preparation of the strip, it is necessary to design the furnace so that it consumes a substantial excess of fuel to provide the heat required to significantly preheat the strip prior to further processing in the annealing system.

The foregoing system has the further disadvantage that when methane or other gaseous hydro-carbon fuels are used with mixtures of air in the proportions needed to create the as designed combustion capacity in the preheat furnace, the resulting products of combustion have expanded many times (on the order of twenty to twenty-five times). This additional gas volume requires a furnace which must be vented at its top or sides in order to prevent a build-up of pressure from furnace gases. Otherwise, the products of combustion seep into the annealing furnace proper which must maintain a hydrogen gas atmosphere to reduce and remove the residuals as discussed above. Such preheat furnaces have serious maintenance problems, and are thus relatively inefficient because of their excessive use of fuel.

Other examples of prior art systems are shown in U.S. Pat. Nos. 1,238,011 to Ellis, 1,310,911 to John, 1,409,119 to Scanlon et al., 1,716,956 to Hepburn et al., 3,166,304 to Alexeff and 3,721,520 to Bloom. The Bloom patent discloses a continuous line for galvanizing wire to protect it from oxidation prior to galvanizing by using a flame burner built into a tube through which the strand is moved.

SUMMARY OF THE INVENTION

It is the purpose of this invention to overcome the disadvantages of the prior art by reducing to a substantial extent the quantity of combustion gases and fuel required to preheat and clean the strip in the furnace prior to continuous annealing. This is accomplished by substantially reducing the flame or combustion area within the preheat furnace and by directing the gases through a confined generally tubular elongated zone so that they remain in prolonged direct flame contact with the strip during the preheating and cleaning process. The preheating operation is thus extended over a relatively longer path of travel while the products of combustion contact the strip as they flow countercurrent to the flow of the strip. This reduces the amount of fuel required to accomplish the required processing.

DESCRIPTION OF THE INVENTION

Figure 1:
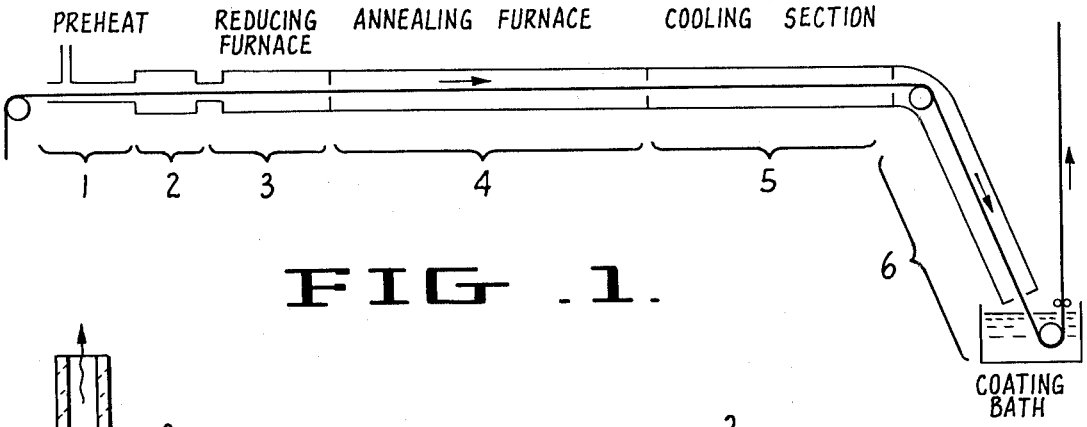
FIG. 1 is a schematic flow sheet of a typical continuous annealing and galvanizing line for steel strip utilizing the preheat furnace of this invention.

Referring to FIG. 1, strip S to be galvanized is continuously passed through tubular zone 1 and flame furnace 2 of the preheat section of the line. It then proceeds through reducing furnace 3 into annealing furnace 4. Thereafter, it enters cooling section 5 preparatory to treatment in coating bath 6. All of the foregoing steps and equipment are conventional except for the treatment in the novel preheat section and the improved effect which it has on the strip received from it and treated in the remainder of the line.

Figure 2:
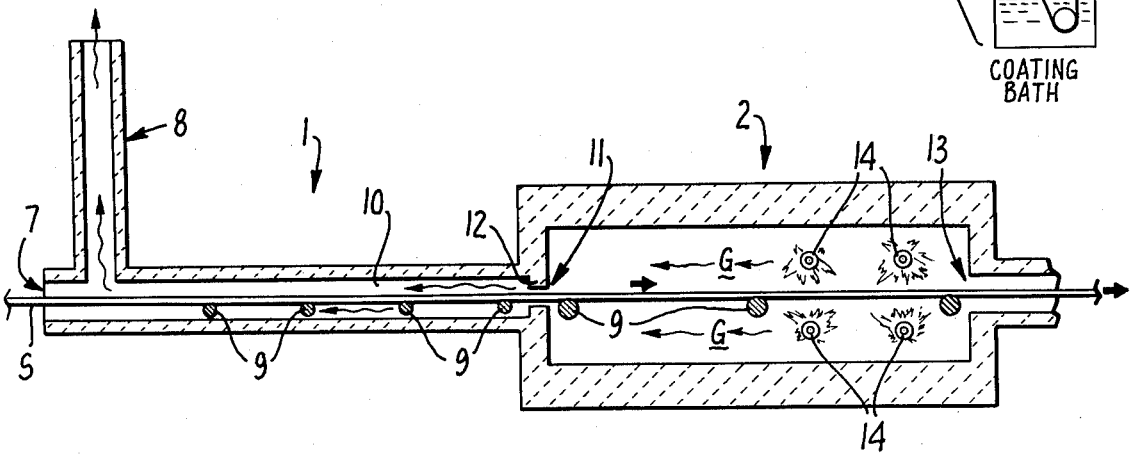
FIG. 2 is a horizontal cross-section through one form of furnace embodying the present invention.
Figure 3:
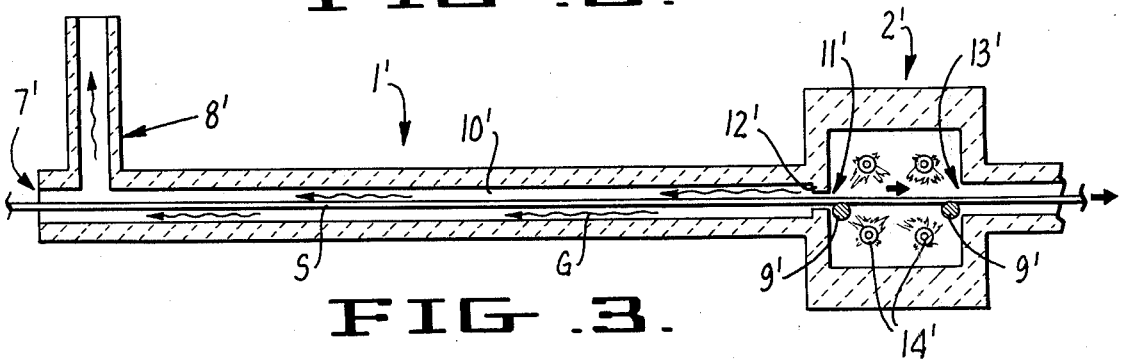
FIG. 3 is a horizontal cross-section of a modified version of another form of the furnace for practicing the present invention.
Figure 4:
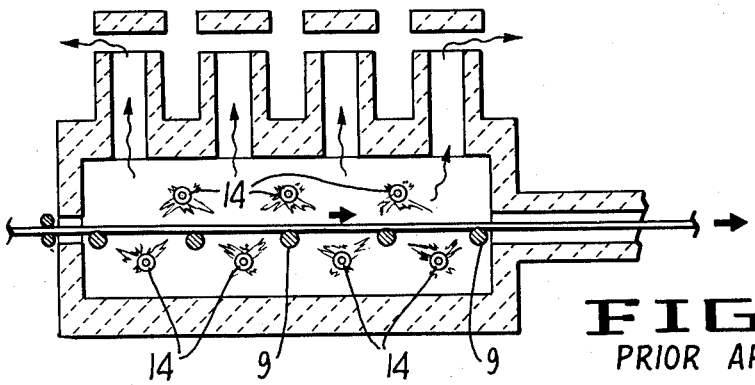
FIG. 4. PRIOR ART
FIG. 4 is a horizontal cross-section of a prior art furnace that will be useful for comparison purposes.

FIG. 2 depicts a preferred form of preheat section of this invention. It will be noted that a furnace of the direct flame contact type is provided which includes burners in only one-quarter to one-third of its area relative to the prior art design shown in FIG. 4. The furnace is entirely closed except for the entry and exit ends thereof as shown in FIG. 2 and through which the strip S and combustion gases pass in countercurrent direction. Prior to the entry end of the furnace, there is located an elongated horizontally flat tubular or envelope-like unit through which the strip first passes as seen in FIGS. 1, 2 and 3. It provides a zone which is of substantial length and relatively small height and width, and which advantageously is designed to limit the zone to a height and width to accommodate the strip to be treated therein.

In more detailed explanation of FIG. 2, the preheat section includes two principal areas, an elongated tubular preheating zone 1 and a closed muffle-type furnace 2. Tubular zone 1 has an open-ended entry through which steel strips are introduced to the system. A buffer stack 8, the function of which will be discussed later in more detail, is located immediately adjacent and above the entry or charging end 7.

Tubular zone 1 is provided with a set of rolls 9, which are substantially the same as those rolls employed in the entire continuous annealing system and which support the strip as it travels horizontally through the various sections of the system. Tubular zone 1 is characterized by an elongated area 10 the length of which is dependent on the available space in a given mill. The elongated area 10 terminates at entry 11 to furnace 2. It will be noted that a restricted orifice 12 of heat resistant material is located at entry 11 to inhibit flow of combustion gases G from furnace 2 and thereby provide a positive pressure throughout the furnace 2.

Furnace 2 is entirely closed except for strip entry 11 and strip exit 13. This is in contrast to the prior art system of FIG. 4 which has a plurality of venting dampers in the furnace roof over each of its multiple flame zones.

Furnace 2 of FIG. 2 uses a substantially reduced flame zone and has far fewer open flow burners 14 than heretofore required. The burners 14 are of conventional design, and, for example, may correspond to those shown in U.S. Pat. No. 2,933,425 to Hess.

The reduced number of burners needed for generating the combustion gases that provide the total heat requirements of the furnace is one of the principal novel features of the invention. This is the result of the direct flame contact of the combustion gases G with strip S over the elongated tubular section 1 wherein the residuals on the surface of strip S are more effectively treated for ultimate processing. The foregoing is in contrast to the furnace section of the prior art which requires several controlled heating zones as mentioned above, to achieve satisfactory processing of the residuals on the surface of strip S which in the prior art entered the furnace at ambient temperature.

FIG. 2 is in effect an adaptation of the prior art furnace to the system of the invention without rebuilding the furnace and wherein the venting dampers have been eliminated and the roof thus sealed off. Also, by such an arrangement, several of the combustion zones have been eliminated while at the same time a more effective use is made of the reduced amount of heat in the lesser volume of combustion gases G.

Among the advantages of the invention are substantial reduction of fuel requirements due to more effective use of heat as previously described, materially reduced furnace maintenance especially in the furnace roof due to elimination of the venting dampers, increased cleanliness of the strip as indicated by the elimination of virtually all adherence problems during subsequent coating operations, and the ability to obtain better heating values on the treated strip.

In the prior art furnace dampers, it is necessary to reline the damper seats several times over any six-month period while during the same time period these areas of the furnace of this invention have not required any relining or other maintenance.

In the present invention the furnace dampers of the prior art are eliminated because the gases exit the furnace through the elongated area 10 of tubular zone 1. At a point immediately adjacent to the entry end of the tubular zone, an appendage zone or stack 8 is installed vertically to a height that is above the highest point of the entire furnace complex. This stack unit is rectangular in cross-section and has inside dimentions equal to or greater than the tubular zone 1. The top of the stack 8 is open to the outside atmosphere where the combustion gases are vented. The unit also acts as a buffer venting unit during the periods immediately following a line stop. The heat transfer conditions in the unit at that time exhaust any encroaching air that may be drawn into the operation 7.

As will be seen by reference to FIG. 2, the flames produced in the area of the furnace adjacent to the exit from which the strip passes to the annealing section are not vented to the outside atmosphere as in the prior art (see FIG. 4), but are permitted to travel in a single direction through the furnace and along the length of the zone wherein they are in direct contact with the strip. Although of a lesser volume than the prior art, the gases directly and very effectively preheat and clean the strip surface with a minimum of waste heat.

FIG. 3 is a modified version of the preheating and cleaning furnace whereby the size of the closed furnace is substantially reduced and the strip exit is at the immediate end of the burner area so that the flame contact in the confined tubular zone begins immediately after the flame zone of the furnace. This design represents a more compact furnace in contrast to the system of FIG. 2. Otherwise, the preheat section of FIG. 3 is essentially the same as that of FIG. 2 in that it includes tubular zone 1' having an open entry 7', a venting stack 8', conventional rollers 9' for supporting strip S, an elongated area 10', and a restricted exit 12' to inhibit unrestricted flow of gases G from furnace 2'. Accordingly, the distinctive feature of the species of the invention of FIG. 3 is that the interior of direct flame contact furnace 2' is limited in its dimensions to the space occupied by the burners required to produce the reduced quantity of combustion gases that distinguishes this invention over the prior art, i.e., the effective size of furnace 2' corresponds to the minor portion of the furnace used as a burner area in furnace 2 of FIG. 2.

The reactions of gases G on the surface contaminants (residuals) of strip S are in general similar to those of the prior art except that the residuals are more effectively processed because of the more prolonged exposure of strip S to direct flame contact. The combustion gases are of a reducing nature so that the contaminants are apparently volatized as the strip passes through the preheat section. The reducing nature of the gas is enhanced by the hydrogen in the gases used in the conventional reduction section of the system and which gases flow into the preheat furnace and exit the system through the tubular zone.

In actual operation beyond the preheat zone, any residual coating on the strip is removed in the reducing section so that clean strip enters the annealing furnace. The annealing section of the furnace which is of the standard type, is preceded by a reducing section having an atmosphere provided by a hydrogen containing gas (HNX) which reacts to further remove any residual coating on the strip prior to annealing. The standard practice thereafter is to anneal and cool the strip prior to its exit into the atmosphere or into a coating unit.

EXAMPLE

In a typical operation steel strip enters the system in the tubular zone at ambient temperature and as it passes through the length thereof into the flame furnace, it has gained appreciably higher temperatures than at the same point in prior art operations. The heating continues during the passage of the sheet through the entire preheat furnace, including the combustion zone. The temperature of the combustion gases in the burner area within the preheat furnace are maintained within the range of from about 2000° F. to about 2400° F. and directly contact the strip in the furnace and zone. The residue from most rolling oils is volatilized at about 1200° F. to 1400° F., so that the remaining heat in the furnace goes to preheat the strip S. The strip thereafter passes through the confined passage at the exit end of the preheater and cleaner and into the annealing zone proper. From that point on, the reducing, annealing and galvanizing steps are those which are conventionally employed in modern steel plant practices.

The protective atmosphere gases as previously stated flow countercurrent to the strip and reduce any remaining residue on the surface thereof as it passes through the annealing system. These protective gases also enter the combustion chamber of the preheater furnace and contribute further heat thereto. The protective gases pass along with the combustion gases from the preheater into and through the tubular zone and are vented as previously described.

Although this invention has been described as part of a continuous galvanizing system, it can be used effectively in any continuous line where clean strip metal is required, including tin and aluminum coating operations. Also, although it has been described as used in a strip annealing system, it can be applied to other fabricated forms, such as wire, etc., as well as with other metals.

While in accordance with the provisions of the Statutes I have illustrated and described the best form of embodiment of my invention now known to me, it will be apparent to those skilled in the art that changes may be made in the form of the apparatus and process disclosed without departing from the spirit and scope of the invention set forth in the appended claims, and that in some cases certain features of my invention may be used to advantage without a corresponding use of other features.

I claim the following:

1. A process for continuously annealing metal strip comprising, (a) introducing strip to be annealed into a single elongated tubular preheat zone and passing it therethrough as said strip contacts hot combustion gases flowing in a direction opposite to the direction of flow of said strip, (b) passing said strip into a separate closed direct flame contact furnace wherein combustion gases are generated for direct flame contact on the surface of said strip within said furnace to thereby continue the preheating and cleaning thereof to effectively remove surface contaminants therefrom, (c) thereafter subjecting said strip to a series of consecutive steps comprising:

(i) subjecting said strip to a reducing area within an atmosphere of hydrogen containing protective gases;

(ii) annealing said strip; and (iii) cooling said strip;

(d) permitting said protective gases and said combustion gases to flow in a single direction countercurrent to the direction of travel of said strip through said furnace and then through said zone and exhausting said gases from the strip entry end of said preheat zone.

2. The process of claim 1 wherein the metal strip is steel strip.

3. The process of claim 1 wherein the metal strip is subjected to a zinc galvanizing operation after cooling said strip.

4. The method of claim 1 wherein the elongated tubular zone through which the metal strip is passed is of restricted dimensions generally approximately the shape of said strip whereby said combustion gases and said protective gases are in direct contact with said strip over the length of said zone.

5. The method of claim 1 wherein the combustion gases from said surface are of a restricted volume and impinge directly on said strip as they enter said elongated tubular zone.

* * * * *